US006545404B2

(12) United States Patent
Tagami

(10) Patent No.: US 6,545,404 B2
(45) Date of Patent: Apr. 8, 2003

(54) COLOR DISPLAY TUBE HAVING A NON-CIRCULAR NECK PORTION

(75) Inventor: Etsuji Tagami, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 49 days.

(21) Appl. No.: 09/800,411

(22) Filed: Mar. 6, 2001

(65) Prior Publication Data

US 2001/0020816 A1 Sep. 13, 2001

(30) Foreign Application Priority Data

Mar. 7, 2000 (JP) ..... 2000-061498

(51) Int. Cl.[7] ..... H01J 29/70; H01J 29/00; H01J 31/00

(52) U.S. Cl. ..... 313/440; 313/441; 313/477 R; 220/2.3 A

(58) Field of Search ..... 313/440, 441, 313/438, 456, 477 R; 220/2.3 A, 2.1 A

(56) References Cited

U.S. PATENT DOCUMENTS 3,246,192 A * 4/1966 Torsch ..... 313/431
6,208,068 B1 * 3/2001 Lee et al. ..... 313/477 R
6,404,119 B1 * 6/2002 Hidaka et al. ..... 313/477 R

FOREIGN PATENT DOCUMENTS

JP 3-192636 8/1991

OTHER PUBLICATIONS

Kawasaki et al., "Double–Neck View–Finder Tube", *National Technical Report*, vol. 38, No. 4, pp. 408–415 and its partial English Translation.

* cited by examiner

*Primary Examiner*—Nimeshkumar D. Patel
*Assistant Examiner*—Matt Hodges
(74) *Attorney, Agent, or Firm*—Merchant & Gould, P.C.

(57) ABSTRACT

In a color display tube including an envelope including a front panel and a funnel, and an electron gun provided in a neck portion of the funnel, a horizontal outer diameter of the neck portion in a region on a rear end side is greater than a vertical outer diameter thereof in this region and a horizontal outer diameter thereof in a region on the front panel side, and a main lens of the electron gun is formed in the region on the rear end side. With this configuration, it is possible to achieve both an electric power saving and a high resolution in a display screen in a color display tube device, as well as to mount a deflection yoke in the color display tube easily.

3 Claims, 5 Drawing Sheets

COLOR DISPLAY TUBE HAVING A NON-CIRCULAR NECK PORTION

BACKGROUND OF THE INVENTION

1. Field of the Invention

The present invention relates to a color display tube and a color display tube device used for example in a television or a computer display.

2. Description of Related Art

A cathode ray tube including an in-line color display tube generally has a cylindrical glass neck portion that surrounds an electron gun and is connected to a cone portion that flares like a bell from the neck portion toward a screen of a front panel. A region from the neck portion toward the cone portion is provided with a deflection yoke for deflecting an electron beam emitted from the electron gun.

A deflection power P, which is an electric power consumption of the deflection yoke, is proportional to a diameter Da of the neck portion and a diameter Dc of a ferrite core in the deflection yoke, as indicated by the following equation.

$$P=k\cdot Da\cdot Dc\cdot \sin^2(\alpha/2)L$$

k: constant, $\alpha$: deflection angle, L: deflection length

In other words, a smaller neck diameter linearly brings about a smaller deflection power, thereby saving electric power.

However, when the neck diameter is reduced, a main lens aperture of the electron gun also decreases. Since the diameter of a beam spot is proportional to the $\leqq$¾ power of the main lens aperture, the smaller neck diameter leads to an increase in the beam spot diameter. This is disadvantageous in achieving high resolution.

Thus, the electric power saving achieved by the smaller neck diameter and the high resolution cannot be obtained at the same time. In a mainstream color display tube, an improved electron gun has been under development in order to achieve the high resolution while keeping a constant neck diameter Da of 29.1 mm.

On the other hand, one of the cathode ray tubes is a miniature cathode ray tube for a viewfinder in a video camera, in which a two-stage neck diameter Da has been suggested and produced commercially as a technology to achieve the electric power saving and the high resolution at the same time with respect to the neck diameter (for example, JP 3(1991)-192636 A, and National Technical Report Vol. 38, No. 4, August 1992, pages 408–415). In this technology, the neck diameter is extended in the electron gun region where the main lens is located, while the neck diameter is reduced in the region where the deflection yoke is mounted.

However, in this conventional two-stage neck diameter Da, the deflection yoke has to be assembled directly in the cathode ray tube because physical limitations make it impossible to attach the normally-produced deflection yoke to and remove it from the cathode ray tube. This has posed a serious problem in productivity. This is because the deflection yoke that matches the two-stage neck diameter has an inner diameter having a portion smaller than the neck diameter in the rear end of the cathode ray tube, and the neck portion, therefore, cannot be inserted in the deflection yoke.

In other words, when the deflection yoke is assembled directly in the cathode ray tube during its manufacture, the degree of freedom in assembly is smaller and the productivity is lower than the case of manufacturing the deflection yoke separately. In addition, assembly jigs cannot be introduced optimally, making it difficult to maintain a high quality. Furthermore, it is impossible to spot defective products individually with respect to the cathode ray tubes and the deflection yokes, leading to serious problems such as high cost of quality loss. Thus, the cathode ray tube with the two-stage neck diameter Da so far has not led to a commercialization in a color display tube device used in a television, a computer display or the like, other than in the actual example of the miniature cathode ray tube for the viewfinder described above.

SUMMARY OF THE INVENTION

It is an object of the present invention to solve the problems described above and to provide a color display tube and a color display tube device that can achieve both an electric power saving and a high resolution easily without lowering productivity or quality.

In order to achieve the object mentioned above, a color display tube according to the present invention includes an envelope including a front panel and a funnel, and an electron gun provided in a neck portion of the funnel. A horizontal outer diameter of the neck portion in a region on a rear end side is greater than a vertical outer diameter thereof in this region and a horizontal outer diameter thereof in a region on the front panel side. A main lens of the electron gun is formed in the region on the rear end side.

Also, a color display tube device of the present invention includes the above-described color display tube, and a deflection yoke arranged so that a rear end of horizontal deflection coils is located in the region on the front panel side of the neck portion. A horizontal inner diameter of the rear end of the horizontal deflection coils of the deflection yoke is greater than the vertical outer diameter of the neck portion in the region on the rear end side. A vertical inner diameter of the rear end of the horizontal deflection coils is greater than the horizontal outer diameter of the neck portion in the region on the rear end side.

According to the color display tube and the color display tube device of the present invention, it is possible to achieve both the electric power saving and the high resolution easily without lowering productivity or quality.

In the above color display tube device, it is preferable that the horizontal inner diameter of the rear end of the horizontal deflection coils of the deflection yoke is smaller than the horizontal outer diameter of the neck portion in the region on the rear end side. This makes it possible to reduce a horizontal deflection power, thereby further saving the electric power.

DESCRIPTION OF THE PREFERRED EMBODIMENTS

The following is a description of an embodiment in which the present invention is applied to a 76-cm (32-inch) color display tube device, with reference to the accompanying drawings.

Figure 1:
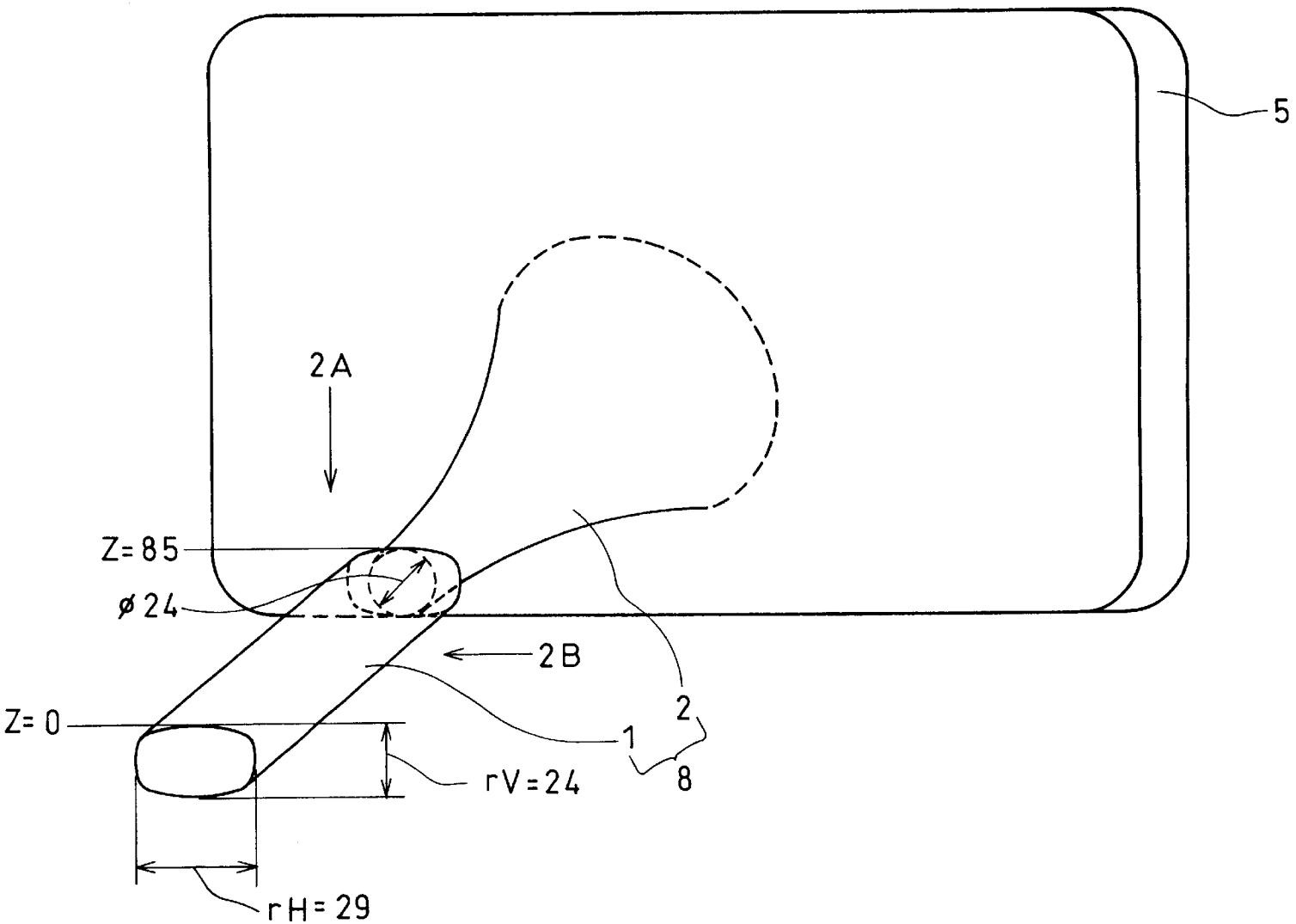
FIG. 1 is a perspective view showing a color display tube of the present invention.

FIG. 1 shows a color display tube of the present invention seen obliquely from behind. The color display tube has an envelope including a front panel 5 and a funnel 8. The funnel 8 includes a cylindrical neck portion 1 and a bell-shaped cone portion 2. A coordinate is set for the present description such that a tube axis of the color display tube corresponds to a Z-axis (not shown in the figure), an end face on a cathode side of a base of an electron gun that is provided in the neck portion (not shown in the figure) corresponds to Z=0, and the side of a screen is the + side. The "base" here denotes a base that is provided on a rear end of the color display tube on the electron gun side as a terminal of an electron gun electrode. The "end face on the cathode side" denotes a surface of the base on a front panel 5 side. A main lens to be formed in the electron gun is designed so that its center is located at Z=84 mm. In addition, a direction corresponding to a long side of a substantially rectangular screen that is formed on the front panel 5 is called a horizontal direction, and that corresponding to a short side thereof is called a vertical direction.

The range of Z=0 to 85 mm (the region on the rear end side) of the neck portion 1, which includes a position where the main lens of the electron gun is formed, has a substantially elliptical shape with a horizontal outer diameter rH=29 mm and a vertical outer diameter rV=24 mm. This is a shape equivalent to that obtained by cutting the upper and lower 2.5 mm in the vertical direction from a cylinder having an outer diameter of ϕ29 mm so as to form parallel flat surfaces with a distance of 24 mm therebetween.

Figure 2A:
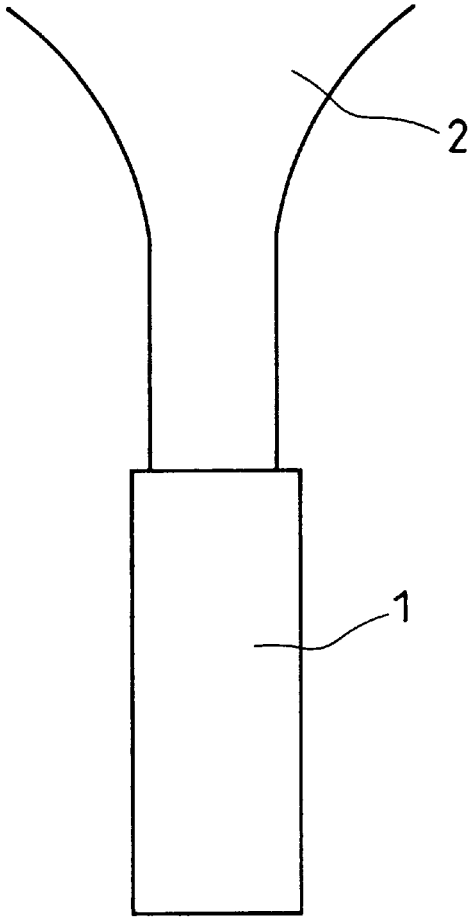
FIGS. 2A and 2B are enlarged views showing a neck portion of the color display tube of the present invention, with FIG. 2A seen in a vertical direction and FIG. 2B seen in a horizontal direction.
Figure 2B:
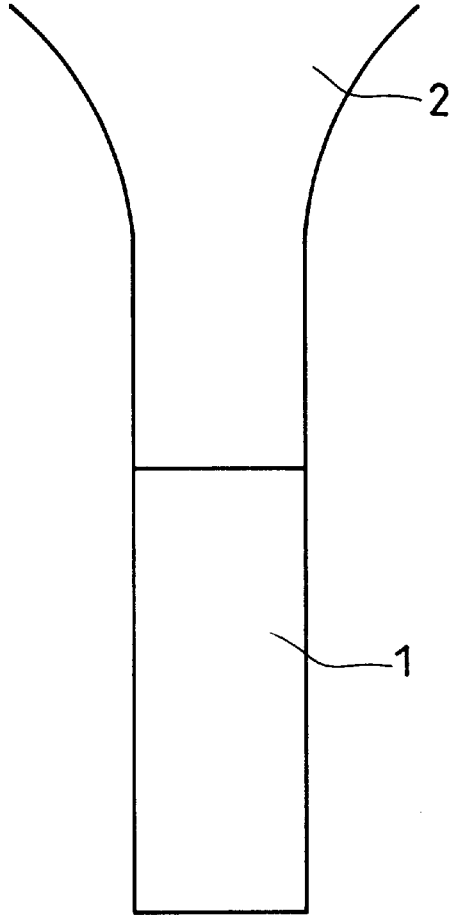

In the range of Z=85 mm or larger, namely, the region on the side of the screen of the front panel 5, the cone portion 2 that flares like a bell toward the screen is connected to the cylindrical neck portion having an outer diameter of ϕ24 mm (this region of the neck portion will be referred to as "a region on the front panel side"). As described above, the neck portion 1 according to the present invention has a cylindrical shape having an outer diameter of ϕ24 mm on the screen side until Z=85 mm. Then, the outer diameter in the horizontal direction alone increases from 24 mm to 29 mm on the main lens side of the electron gun with respect to Z=85 mm. In other words, the neck portion 1 has a two-stage structure with respect to the outer diameter in the horizontal direction alone. FIGS. 2A and 2B are views illustrating the neck portion 1 seen in the vertical direction (an arrow 2A direction in FIG. 1) and in the horizontal direction (an arrow 2B direction in FIG. 1) respectively.

Figure 3:
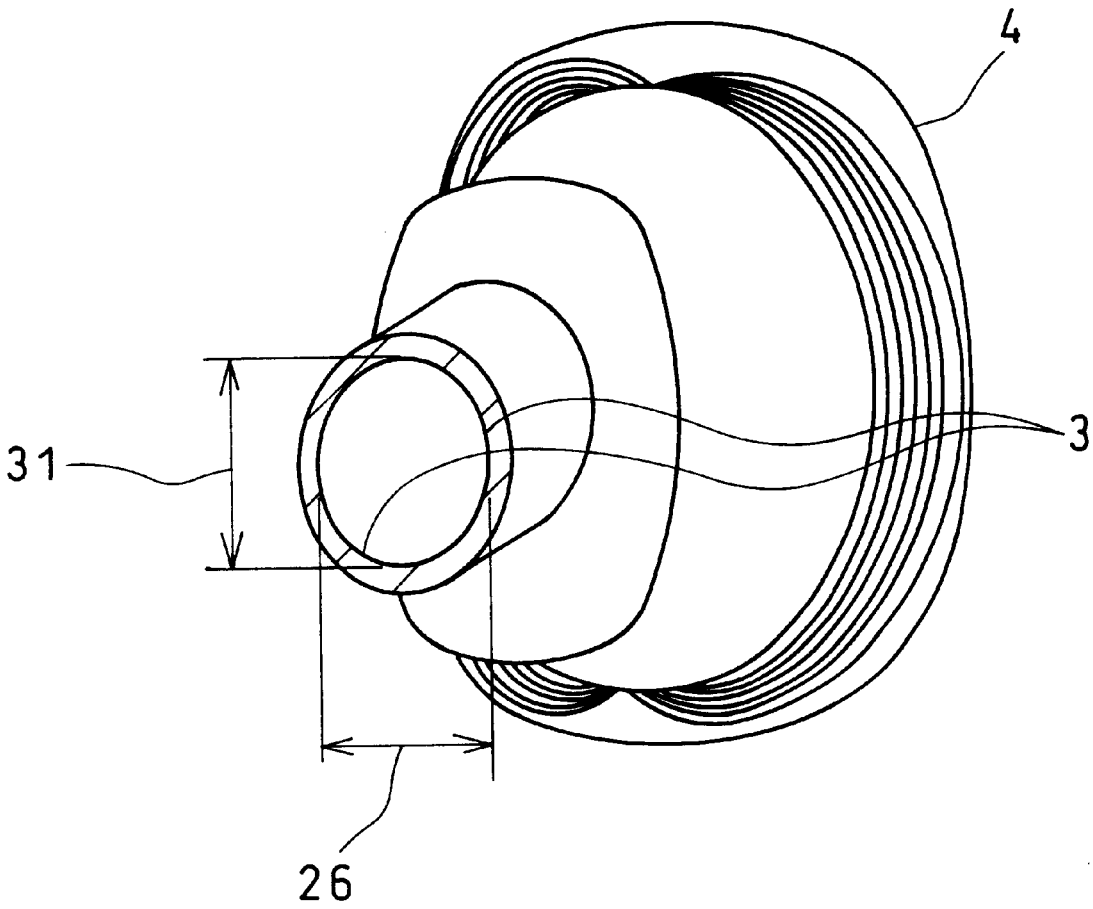
FIG. 3 is a perspective view showing a deflection yoke of a color display tube device of the present invention.
Figure 4:
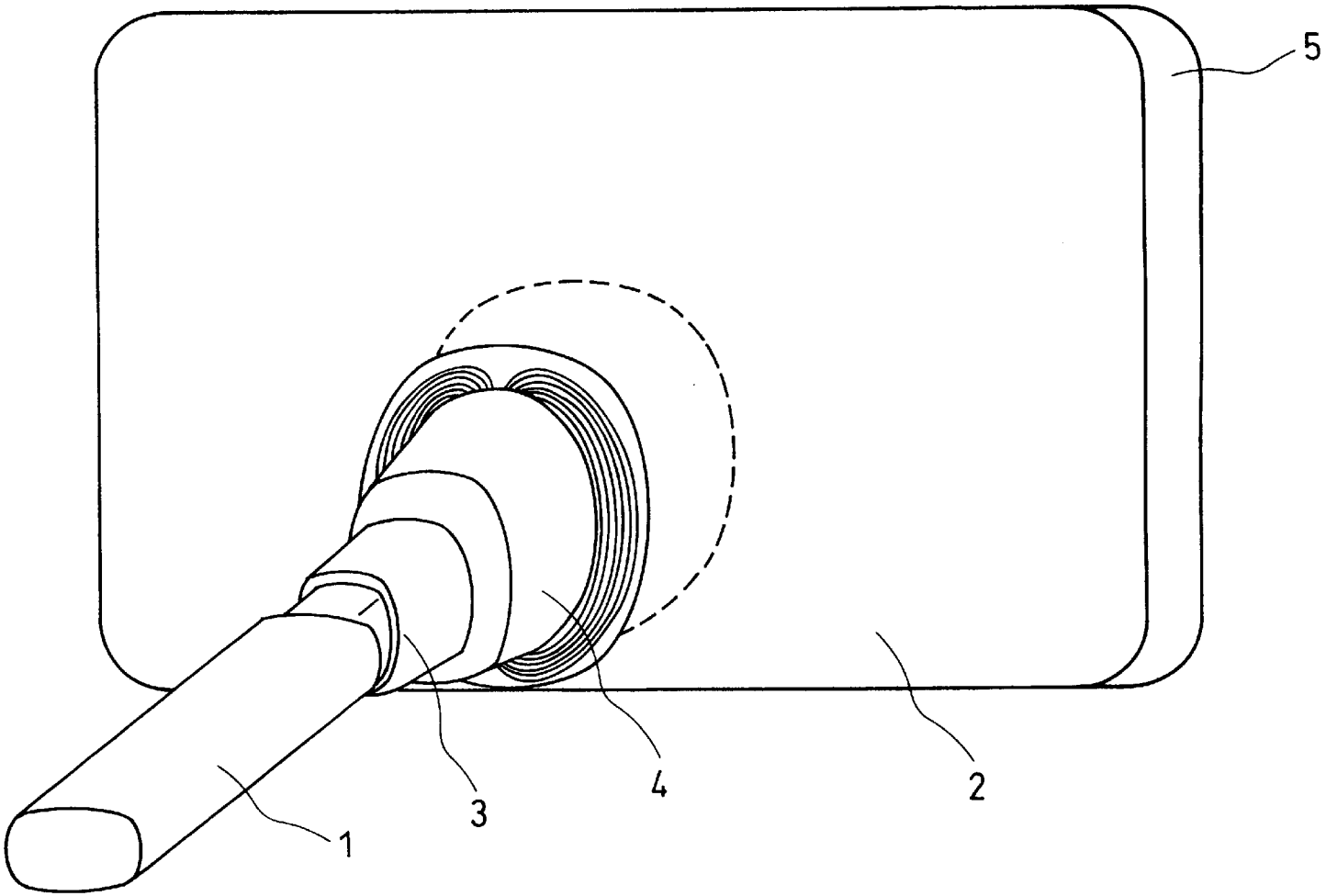
FIG. 4 is a perspective view showing the color display tube device of the present invention.

FIG. 4 shows the color display tube device of the present invention seen obliquely from behind as in FIG. 1, and FIG. 3 shows a deflection yoke 4 alone. A pair of horizontal deflection coils 3 that are provided in the deflection yoke of the present invention form a virtually cylindrical shape with its rear end being substantially elliptic. In its cross-section taken perpendicularly to the Z-axis, the inner diameter in the horizontal direction is 26 mm, and that in the vertical direction is 31 mm. This is a shape equivalent to that obtained by adding upper and lower 2.5 mm to the ϕ26-mm inner diameter of a cylinder. The vertical inner diameter of the horizontal deflection coils 3 is greater than the 29-mm horizontal outer diameter of the neck portion 1, and the horizontal inner diameter of the horizontal deflection coils 3 is greater than the 24-mm vertical outer diameter of the neck portion 1. Thus, the neck portion 1 can be inserted in the deflection yoke 4 while the deflection yoke 4 is being rotated by 90° around the Z-axis.

The deflection yoke 4, in which the neck portion 1 now can be inserted thanks to the geometric rotation by 90°, is moved forward until its rear end reaches the region on the front panel side of the neck portion 1 having a diameter of ϕ24 mm both horizontally and vertically. Then, the deflection yoke 4 is rotated geometrically by 90° again toward its normal direction, so as to be attached. The horizontal deflection coils 3 have a horizontal inner diameter of 26 mm, which is suitable for being mounted in the neck portion having an outer diameter of 24 mm. Accordingly, a horizontal deflection power that accounts for the most part of the deflection power can be reduced, thereby saving an electric power. On the other hand, the 31-mm vertical inner diameter of the deflection yoke can secure a vertical deflection power equivalent to that of the deflection yoke corresponding to a normal ϕ29-mm cylindrical neck portion.

As described above, the attachment and removal of the deflection yoke, which could not achieved by the conventional two-stage neck diameter, now are made possible by the two-stage structure of the neck diameter in the horizontal direction and the simply smaller neck diameter in the vertical direction.

In an actual measurement, the conventional color display tube device having a cylindrical neck portion with an outer diameter of ϕ29 mm showed a horizontal deflection power of $LH \cdot IH^2 = 43\ mH \cdot A^2$, while the color display tube device of the present invention showed $LH \cdot IH^2 = 36.5\ mH \cdot A^2$, indicating a 15% power reduction. LH denotes inductance in a horizontal deflection system, and IH denotes a peak-to-peak value of a horizontal deflection current.

Figure 5:
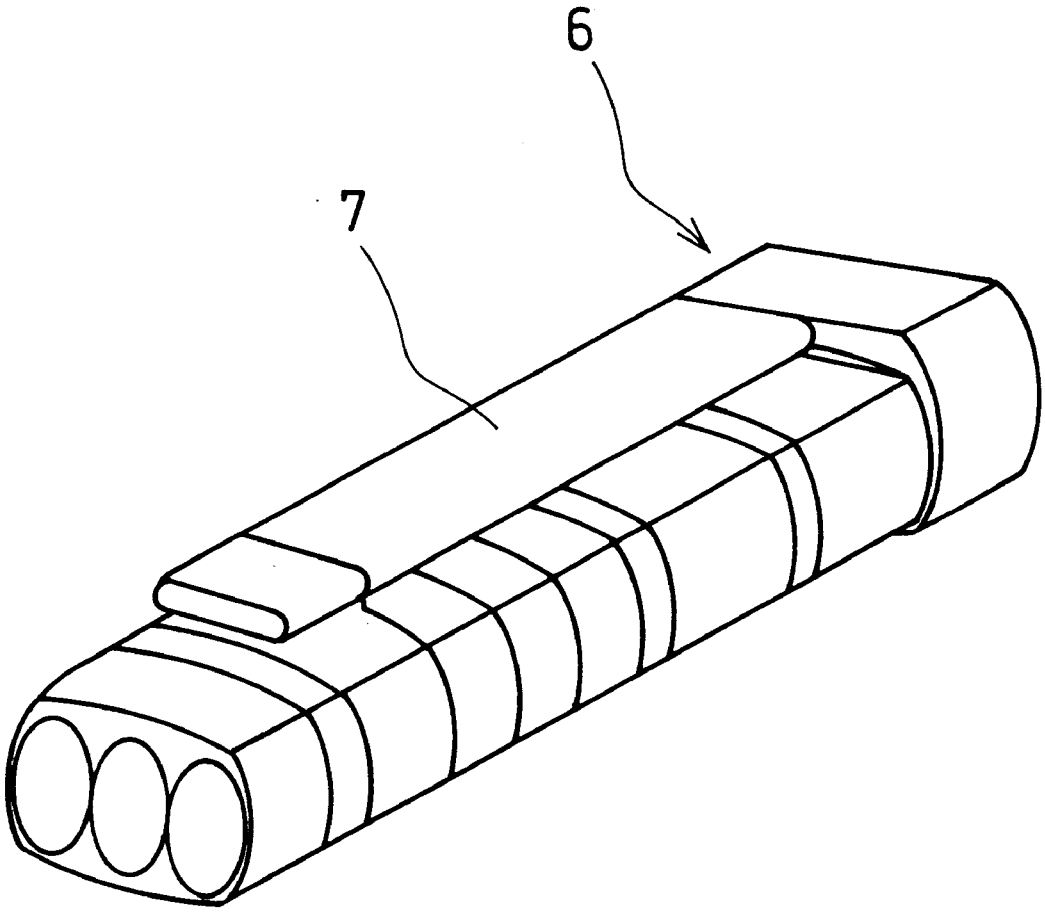
FIG. 5 is a perspective view showing an electron gun.

An electron gun 6 (shown in FIG. 5) was an in-line type electron gun emitting three electron beams of R, G and B in the horizontal direction, and was designed optimally for the neck portion having an outer diameter of 29 mm. If the horizontal outer diameter of the neck portion had been reduced, a main lens aperture also would have decreased. Therefore, the horizontal outer diameter of the neck portion in the region on the rear end side was maintained to be 29 mm. With respect to the vertical outer diameter of the electron gun 6, which was designed optimally for the neck portion having an outer diameter of 29 mm, on the other hand, a 4-mm vertical reduction was made possible by which the thickness of multi-glass supports 7 that were structural components and provided on upper and lower surfaces was reduced from 4 mm to 2 mm respectively. In addition, a part of the electron gun 6 that was not related to the aperture of the lens for each electrode (a part in which the change in the size of this part did not affect the size of the lens aperture in the electrode design) was designed to be 1 mm smaller. Thus, the vertical diameter was reduced by 5 mm in total, thereby achieving a 24-mm vertical outer diameter of the neck portion in the region on the rear end side. In this manner, by using the electron gun sealed in the neck portion having a substantially elliptic shape with a horizontal outer diameter rH=29 mm and a vertical outer diameter rV=24 mm in the range of Z=0 to 85 mm, it became possible to provide a lens aperture and performance that were equivalent to those when using the conventional electron gun for the cylindrical neck portion with a ϕ29 mm.

Although the present invention also can be applied to color display tube devices other than the 32-inch color display tube device described above, it particularly is effective for a large color display tube device in which a smaller neck diameter is difficult to achieve. When considering a manufacturing cost, the present invention is suitable for 29-inch or larger color display tube devices.

As described above, in accordance with the present invention, it is possible to obtain both an electric power saving and a high resolution in a display screen by designing the neck diameter to have the two-stage structure only in the horizontal direction of the color display tube, and to achieve the attachment and removal of the deflection yoke, which were not yet achieved by the conventional two-stage neck diameter, thereby manufacturing the color display tube without lowering productivity or quality at all.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color display tube comprising:

an envelope comprising a front panel and a funnel; and an electron gun provided in a neck portion of the funnel;

wherein a horizontal outer diameter of the neck portion in a region on a rear end side is greater than a vertical outer diameter thereof in this region and a horizontal outer diameter thereof in a region on the front panel side, and a main lens of the electron gun is formed in the region on the rear end side.

2. A color display tube device comprising:

the color display tube according to claim 1; and a deflection yoke arranged so that a rear end of horizontal deflection coils is located in the region on the front panel side of the neck portion;

wherein a horizontal inner diameter of the rear end of the horizontal deflection coils of the deflection yoke is greater than the vertical outer diameter of the neck portion in the region on the rear end side, and a vertical inner diameter of the rear end of the horizontal deflection coils is greater than the horizontal outer diameter of the neck portion in the region on the rear end side.

3. The color display tube device according to claim 2, wherein the horizontal inner diameter of the rear end of the horizontal deflection coils of the deflection yoke is smaller than the horizontal outer diameter of the neck portion in the region on the rear end side.

* * * * *